US006365031B1

(12) United States Patent
Martyak et al.

(10) Patent No.: US 6,365,031 B1
(45) Date of Patent: Apr. 2, 2002

(54) HIGH CURRENT DENSITY ZINC SULFATE ELECTROGALVANIZING PROCESS AND COMPOSITION

(75) Inventors: Nicholas M. Martyak, Doylestown, PA (US); John E. McCaskie, Princeton, NJ (US)

(73) Assignee: Atotech U.S. A., Inc., Philadelphia, PA (US)

( * ) Notice: Subject to any disclaimer, the term of this patent is extended or adjusted under 35 U.S.C. 154(b) by 0 days.

(21) Appl. No.: 09/645,936

(22) Filed: Aug. 25, 2000

Related U.S. Application Data

(60) Continuation of application No. 09/752,040, filed on Feb. 9, 1998, which is a division of application No. 08/754,381, filed on Nov. 21, 1996, now Pat. No. 5,718,818, which is a division of application No. 08/388,844, filed on Feb. 15, 1995, now abandoned.

(51) Int. Cl.[7] ..... C25D 3/22
(52) U.S. Cl. ..... 205/313
(58) Field of Search ..... 205/313

(56) References Cited

U.S. PATENT DOCUMENTS

| | | | | |
|---|---|---|---|---|
| 3,537,959 A | | 11/1970 | Korpiun et al. | 205/313 |
| 3,878,069 A | | 4/1975 | Todt et al. | 205/311 |
| 3,957,595 A | | 5/1976 | DuBrow et al. | 205/309 |
| 3,960,677 A | | 6/1976 | Hildering et al. | 205/313 |
| 4,137,133 A | | 1/1979 | Arcilesi | 205/311 |
| 4,379,738 A | | 4/1983 | Kohl | 205/311 |
| 4,416,787 A | | 11/1983 | Marshall et al. | 252/8.8 |
| 4,441,929 A | * | 4/1984 | Marcellis et al. | 106/90 |
| 4,512,856 A | | 4/1985 | Paneccasio | 205/314 |
| 4,515,663 A | | 5/1985 | Strom et al. | 205/245 |
| 4,543,166 A | | 9/1985 | Lash | 205/246 |
| 4,581,110 A | | 4/1986 | Tsuchida et al. | 205/245 |
| 4,740,277 A | * | 4/1988 | Klos et al. | 204/44.2 |
| 4,762,522 A | | 8/1988 | Maue | 8/94.19 R |
| 4,797,183 A | | 1/1989 | Yamamoto et al. | 205/50 |
| 4,877,497 A | | 10/1989 | Watanabe et al. | 205/311 |
| 4,997,471 A | | 3/1991 | Mente | 71/65 |
| 5,200,057 A | * | 4/1993 | Canaris | 205/313 |

FOREIGN PATENT DOCUMENTS

| | | |
|---|---|---|
| WO | 83/02290 | 7/1983 |

* cited by examiner

*Primary Examiner*—Edna Wong
(74) *Attorney, Agent, or Firm*—Finnegan, Henderson, Farabow, Garrett & Dunner, L.L.P.

(57) ABSTRACT

A high current density electrogalvanizing process and composition are disclosed for reducing high current density dendrite formation and controlling high current density roughness, grain size and orientation of a zinc coating obtained from an acidic aqueous zinc salt. The process comprises adding a sulfonated condensation product of naphthalene and formaldehyde to the acidic aqueous zinc salt in an electrolytic cell and applying an electromotive force to the anode and cathode in the cell sufficient to produce a high current density on the cathode. The composition consists essentially of an acidic aqueous zinc salt aqueous in combination with a sulfonated condensation product of naphthalene and formaldehyde which is used as an antidendritic agent.

8 Claims, No Drawings

HIGH CURRENT DENSITY ZINC SULFATE ELECTROGALVANIZING PROCESS AND COMPOSITION

RELATED APPLICATIONS

The present application is a continuation application of U.S. patent application Ser. No. 09/752,040 filed Feb. 9, 1998, pending, which is a divisional of U.S. patent application Ser. No. 08/754,381, filed Nov. 21, 1996 now U.S. Pat. No. 5,718,818, which is a Divisional Application of U.S. patent application Ser. No. 08/388,844, filed Feb. 15, 1995, now abandoned, the contents of all applications being incorporated herein by reference in their entirety.

BACKGROUND OF THE INVENTION

1. Field of the Invention

The field of the invention is a composition of matter used as an additive to high current density zinc plating, consisting essentially of a zinc salt and an additive, and processes utilizing such composition for reducing high current density dendrite formation, controlling high current density roughness, grain size, and crystallographic orientation of a zinc coating obtained from the bath.

2. Description of Related Art

Zinc corrosion resistant coatings which are applied electrolytically on ferrous metals such as steel are used extensively in industries where corrosion resistance is required, such as in the automotive industry.

Zinc offers sacrificial protection to ferrous metals because it is anodic to the substrate which is protected so long as some zinc remains in the area to be protected. The presence of minor pin holes or discontinuities in the deposit is of little significance. Zinc is plated continuously in most industrial processes such as the electrogalvanic coating of continuous steel substrates employed in the automotive and tubular steel industries. Acid chloride and sulfate baths are used extensively because they are capable of higher plating speeds than cyanide baths.

They have also displaced cyanide baths because of EPA regulations requiring the reduction or elimination of cyanide in effluents. The chloride baths include neutral chloride baths containing ammonium ions and chelating agents and acid chloride baths having a pH of from about 3.0 to about 5.5 that substitute potassium ions for the ammonium ions used in the neutral baths. Acid baths have largely replaced neutral ones in practice.

The ASTM specification for zinc deposits on ferrous metals call for thicknesses of from about 5 to about 25 $\mu$m, depending on the severity of the expected service.

ASTMB633-78, Specification For Electrodeposited Coatings Of Zinc On Iron and Steel Zinc is deposited from aqueous solutions by virtue of a high hydrogen over voltage since hydrogen would be preferentially deposited under equilibrium conditions.

Typical plating tanks employed in these processes contain anywhere from about 5,000 to about 300,000 gallons and can be employed for plating either zinc or a zinc alloy such as a zinc-nickel alloy. These are continuous plating baths which will accommodate steel rolls about 8 feet in diameter at speeds of anywhere from about 200 to about 850 feet per minute with varying coating weights of from about 20 to about 80 grams/m$^2$ and coating thicknesses from about 6 to about 10 $\mu$m. The solution flow rate is approximately 0.5–5 m/sec.

The steel is drawn over conductive rolls and is pressed against the roll to provide adequate contact. Soluble zinc or insoluble iridium oxide coated titanium anodes are immersed in the baths adjacent the coating rolls. In the case of zinc-nickel alloy plating operations, nickel carbonate is added to the system. Anode current density varies in accord with cathode current density.

Excess buildup of zinc at high current densities, however, can occur. If a relatively narrow steel strip is being coated, there may be excess anodes in the system. It is impossible to remove the excess anodes because the next strip to be coated may be larger in size. Because of the mechanics of the line, it is too cumbersome to remove and add anodes to accommodate the size of the different substrates being plated. Current densities of about 50 to about 100 A/dm$^2$ (amps per square decimeter) or 400–1,000 ASF (amps per square foot) are employed which also contribute to the excessive buildup of zinc on the edge of the steel substrate. Allowances for such high current density plating are made by adjusting the solution conductivity, providing close anode cathode spacing, and providing a high solution flow rate.

Another major concern is that high current density [HCD] produces roughness in the form of dendrites at the edge of the steel strip that is being coated. These dendritic deposits may break off during plating or rinsing. As the electrogalvanized steel is passed over rollers, these loose dendrites become embedded across the coated substrate and subsequently show up as blemishes which are referred to as zinc pickups. The edges of the steel strip that are coated are also non-uniform in thickness, and burned because of HCD processing. Additionally, HCD processes can cause roughness across the width of the steel strip and change the grain size and crystallographic orientation of the zinc coating. Nonetheless, HCD processes are industrially desirable since production speed is directly related to current density i.e., higher coating line speeds can be obtained at higher current densities.

Accordingly, various grain refiners [GR] and antidendritic agents [ADA] are employed to partially offset these problems. Nonetheless, the problems of edge roughness, non-uniform thickness, and edge burn have not been completely overcome and as a result, most industrial processes require that the edges be trimmed from the steel strip after it is coated. Diamond knives are presently used to trim the edges. Other mechanical means may also be employed to remove excess zinc buildup. The GR and ADA additives also do not completely eliminate problems with HCD roughness, grain size and orientation of the zinc coating.

Additionally, applying a protective coating to the edges of the steel strip prior to zinc plating will also minimize or eliminate edge burn as well as excessive build up of zinc on the edge of the steel substrate. The problem of dendritic deposits, grain size and crystallographic orientation of the zinc coating still persists at high current densities.

It has been found with some of the standard GR or ADA materials that the steel strips exhibit considerable HCD burning at lower additive concentrations whereas nodularity or HCD roughness is still seen at higher concentrations.

The surface roughness of the coated steel strip is expressed in "Ra" units whereas the degree of roughness is expressed in "PPI" units or peaks per inch. These parameters are important in that surface roughness promotes paint adhesion and proper PPI values promote retention of oil which is important during forming operations for zinc coated steel that is used in the manufacture of automobile parts or other parts that are subsequently press formed. A rule of thumb is that the Ra and PPI values should be close to that of the substrate. In some instances it is better to have a zinc coating that is rougher than the substrate rather than smoother and vice versa. Accordingly, the Ra value generally should not be less than or exceed 20% of the Ra value for the substrate dependent upon the desired finish and generally should not exceed about 40 micro inches. The PPI value should be anywhere from about 150 to about 225. Additionally, it has been found that of the various crystallographic orientations of the electrodeposited zinc [(002), (110), (102), (100), (101), and (103)] better results are obtained with a randomly oriented deposit.

As noted, production speed can be increased as current density increases and where current densities presently being employed by industry are at about 1,000 ASF (110 $A/dm^2$) current densities of anywhere from about 1,500 to about 3,000 ASF are being explored in order to obtain higher production rates. Operating at these higher current densities has resulted in unacceptable edge burn, dendritic formation and break off, grain size, problems with obtaining or retention of a given orientation, and unacceptable values for surface roughness.

Additionally, many of the additives to the plating bath employed at about 1,000 ASF do not adequately address the foregoing difficulties.

Korpium et al., U.S. Pat. No. 3,537,959 describes a zinc sulfate electroplating bath and process for producing bright zinc deposits based on a zinc salt in combination with various nitrogen containing compounds and the condensation product of naphthalene sulfonic acids and formaldehyde. The patentee indicates that German Patent No. 292, 531 describes a method for manufacturing the condensation product.

Todt et al., U.S. Pat. No. 3,878,069 describes an acid zinc galvanic bath based on zinc salts, ammonium salts and various luster former materials and an agent for promoting ductile and malleable zinc coatings based on the condensation product of formaldehyde with a naphthalene sulfonic acid.

Pilavov, Russian Patent 1,606,539 describes weekly acidic baths for electrogalvanizing steel containing a condensation copolymer of formaldehyde and 1,5- and 1,8-aminonaphthylalene-sulfonic acid prepared in monoethanolamine. The galvanized steel shows a smaller decrease in ductility compared to that obtained from a conventional bath.

Watanabe et al. U.S. Pat. No. 4,877,497 describe an acidic aqueous electrogalvanizing solution containing zinc chloride, ammonium chloride or potassium chloride and a saturated carboxylic acid sodium or potassium salt. The composition inhibits production of anode sludge.

Tsuchida et al., U.S. Pat. No. 4,581,110 describe a method for electroplating a zinc-iron alloy from an alkaline bath containing iron solubilized with a chelating agent.

Strom et al., U.S. Pat. No. 4,515,663 disclose an aqueous acid electroplating solution for depositing zinc and zinc alloys which contains a comparatively low concentration of boric acid and a polyhydroxy additive containing at least three hydroxyl groups and at least four carbon atoms.

Paneccasio, U.S. Pat. No. 4,512,856 discloses zinc plating solutions and methods utilizing ethoxylated/propoxylated polyhydric alcohols as a novel grain-refining agent.

Kohl, U.S. Pat. No. 4,379,738 discloses a composition for electroplating zinc from a bath containing antidendritic additives based on phthalic anhydride derived compounds and analogs thereof in combination with polyethoxyalkylphenols.

Arcilesi, U.S. Pat. No. 4,137,133 discloses an acid zinc electroplating process and composition containing as cooperating additives, at least one bath soluble substituted or unsubstituted polyether, at least one aliphatic unsaturated acid containing an aromatic or heteroaromatic group and at least one aromatic or N-heteroaromatic aldehyde.

Hildering et al., U.S. Pat. No. 3,960,677 describe an acid zinc electroplating bath which includes a carboxy terminated anionic wetting agent and a heterocyclic brightener compound based on furans, thiophenes and thiazoles.

Dubrow et al., U.S. Pat. No. 3,957,595 describe zinc electroplating baths which contain a polyquaternary ammonium salt and a monomeric quaternary salt to improve throwing power.

SUMMARY OF INVENTION

Accordingly, the present invention is directed to a process and composition that substantially obviates one or more of these and other problems due to limitations and disadvantages of the related art.

These and other advantages are obtained according to the present invention which is the provision of a process and composition of matter that substantially obviates one or more of the limitations and disadvantages of the described prior processes and compositions of matter.

Additional features and advantages of the invention will be set forth in the description which follows, and in part will be apparent from the description, or may be learned by practice of the invention. The objectives and other advantages of the invention will be realized and obtained by the process and composition of matter, particularly pointed out in the written description and claims hereof.

To achieve these and other advantages and in accordance with the purpose of the invention, as embodied and broadly described, the invention comprises a high current density electrogalvanizing process and composition of matter for reducing high current density dendrite formation and controlling high current density roughness, grain size and orientation of a zinc coating obtained from a zinc salt and especially an acidic aqueous zinc sulfate. For the purpose of the invention, the term "acidic aqueous zinc salt" shall mean a zinc salt mixed with water where the mixture obtained has an acid pH. The process is conducted by adding to the acidic aqueous zinc salt a compound comprising a sulfonated condensation product of naphthalene and formaldehyde (the "condensation product") which acts as an antidendritic agent. The acidic aqueous zinc salt and the foregoing condensation product form the composition of matter of the invention.

A current is passed from a zinc anode in the bath to a metal cathode in the bath for a period of time sufficient to deposit a zinc coating on the cathode. High current density of HCD as referred to in this aspect of the invention is intended to include currents from about 50 to about 4,000 ASF or higher or from about 100 to about 3,500 ASF, or from about 300 to about 3000 ASF and especially about 1,000 to about 3,000 or about 4,000 ASF.

DETAILED DESCRIPTION

The zinc electrogalvanic coating baths that may be employed in the composition of, and according to the processes of the present invention generally comprise a mixture of anywhere from about 0.4 to about 2.0 moles, and especially from about 1.2 to about 1.7 moles of zinc salt, e.g. zinc sulfate per liter of solution and optionally from about 0.25 to about 1.5 moles and especially from about 0.75 to about 1.25 moles per liter of solution of an alkali metal salt based on an acid and especially one of the sulfur acids described hereinafter. The alkali metal may be any one of the Group IA metals or mixtures thereof and particularly sodium or potassium and preferably potassium.

The zinc salts that may be employed comprise any zinc salt of a mineral acid including the sulfur acids as defined herein, the phosphorous acids or organic acids having from 1 to about 10 carbon atoms including the aliphatic and cyclic organic acids. These salts include salts of zinc and organo sulfonic acids such as methane sulfonic acid.

The pH of the bath may be anywhere from 0 to about 4.0, or from about 1.2 to about 3.2 and especially from about 1.5 to about 2.2. Acids such as sulfur acids may be added to the bath in order to adjust the pH. These acids are well known in the art and include inter alia 1–10 carbon atom aliphatic or cyclic organic acids, the halogen acids, phosphorous acids or preferably sulfur acids where zinc sulfate is used. These acids include sulfuric, sulfurous, oleum, thiosulfuric, dithionous, metasulfuric, dithionic, pyrosulfuric, or persulfuric acid and the like as well as mixtures thereof and especially the two component or three component mixtures. Sulfuric acid is preferred because of its commercial availability.

The bath is operated at a temperature of from about 100° F. to about 170° F., and especially from about 120° F. to about 150° F.

The electrogalvanizing process is carried out under conditions and in the manner heretofore described for coating a metal substrate and especially a steel substrate by passing a current from an anode known in the art such as iridium oxide coated titanium anodes or a zinc anode immersed in the electrogalvanic coating bath to a metal cathode in the bath for a period of time sufficient to deposit a zinc coating on the cathode.

The condensation product of the invention when added to the acidic aqueous zinc salt reduces high current density dendrite formation and controlling high current density roughness, grain size and orientation of the zinc coating obtained. The condensation product and the acidic aqueous zinc salt comprise the composition of the invention. In another embodiment, the invention consists essentially of the condensation product and the acidic aqueous zinc salt and in a further embodiment the composition consists of the condensation product and the acidic aqueous zinc salt.

The condensation product comprises a sulfonated condensation product of naphthalene and formaldehyde which is used as an antidendritic agent. The condensation product also functions to some degree as a grain refining agent.

The condensation product used as an antidendritic agent is employed in an amount anywhere from about 0.025 to about 1.0 gms/liter and especially from about 0.05 to about 0.2 gms/liter.

The foregoing quantities comprise the quantities of the condensation product prior to addition to the electrogalvanic coating bath. When this condensation product is added to this coating bath, it is preferably added as a solution or dispersion in a liquid, preferably water, so that the condensation product is present in the coating bath in an amount from about 50 to about 200 ppm and especially from about 75 to about 125 ppm based on the molar amount of zinc in the bath.

The preferred sulfonated condensation product of naphthalene and formaldehyde used as an antidendritic agent comprises BLANCOL®-N. An equivalent of BLANCOL®-N is TAMOL®-N which is a methoxylated sulfonate.

It has been found that the composition of the invention is especially effective in reducing dendrite formation and edge burn at high current densities, as defined herein and especially at about 1500 to about 3000 ASF.

EXAMPLES 1–4

Examples 1–4, summarized in Table 1, illustrate the effects of plating without employing the anti-dendritic agent (ADA), e.g., BLANCOL®-N to provide a basis for comparison to a process employing this anti-dendritic agent, and show the effects on surface roughness ($R_a$) and peak count ($P_c$), i.e., the number of peaks per centimeter. The composition employed in examples 1–4 comprised:

Zinc Sulfate, Zn, 65 g/l

Sulfuric Acid, enough to bring the pH to 2.5 pH 2.5

Temperature, 75° C.

Current density: 50 A/dm$^2$, 100 A/dm$^2$, 150 A/dm$^2$, and 200 A/dm$^2$

The apparatus used to plate the samples was a rotating cathode. Steel strips were cut to give surface areas varying from 0.1 square decimeter to 1.0 square decimeters. The steel strips were fixed to a rotating cathode, cylindrical shaft, that was immersed in the zinc electrolytes. The rotating cathode speed varied to equate linear strip speeds from 30–120 meters per minute. Surrounding this rotating cathode was an anode made of pure zinc and the spacing between the cathode and anode was approximately 25 mm.

The zinc solution was pumped in a direction opposite to the direction of cathode rotation. The solution flow rate varied from 0–63 meters per minute.

Table 1 below lists the stirring speed, solution flow rate and current density employed in each of examples 1–4.

In Table 1, the number that precedes the "Ra/Pc" measurement comprises the sample number, the second number is the surface roughness in microns and the third number, the peak count.

TABLE 1

$ZnSO_4$ Electrolyte (Production-Type Solution)

| Strip Speed | Solution Flow Rate | 50 A/dm$^2$ Ra/Pc | | 100 A/dm$^2$ Ra/Pc | | 150 A/dm$^2$ Ra/Pc | | 200 A/dm$^2$ Ra/Pc | |
|---|---|---|---|---|---|---|---|---|---|
| 30 m/min | 0 m/min | 1 | 1.40/72 | 13 | 1.36/83 | 25 | 1.19/81 | 37 | 1.37/87 |
| 60 m/min | | 2 | 1.49/86 | 14 | 1.55/93 | 26 | 1.40/81 | 38 | 1.31/74 |

TABLE 1-continued

| $ZnSO_4$ Electrolyte (Production-Type Solution) | | | | | | | | | | | |
|---|---|---|---|---|---|---|---|---|---|---|---|
| Strip Speed | Solution Flow Rate | | 50 A/dm$^2$ Ra/Pc | | 100 A/dm$^2$ Ra/Pc | | 150 A/dm$^2$ Ra/Pc | | 200 A/dm$^2$ Ra/Pc | | |
| 120 m/min | | 3 | 1.36/72 | 15 | 1.63/80 | 27 | 1.54/82 | 39 | 1.38/75 | | |
| 30 m/min | 21 m/min | 4 | 2.26/78 | 16 | 1.57/85 | 28 | 1.54/95 | 40* | 2.17/142 | | |
| 60 m/min | | 5 | 1.32/71 | 17 | 1.33/83 | 29 | 1.27/82 | 41 | 1.49/82 | | |
| 120 m/min | | 6 | 1.57/84 | 18 | 1.50/81 | 30 | 1.35/79 | 42 | 1.40/85 | | |
| 30 m/min | 42 m/min | 7 | 1.40/65 | 19 | 1.96/87 | 31 | 1.34/89 | 43* | 1.55/114 | | |
| 60 m/min | | 8 | 1.57/77 | 20 | 1.66/100 | 32 | 1.34/82 | 44 | 1.61/106 | | |
| 120 m/min | | 9 | 1.39/76 | 21 | 1.57/90 | 33 | 1.44/83 | 45 | 1.47/85 | | |
| 30 m/min | 63 m/min | 10 | 1.43/72 | 22 | 1.46/88 | 34 | 1.46/76 | 46* | 1.77/116 | | |
| 60 m/min | | 11 | 2.67/80 | 23 | 1.36/78 | 35 | 1.40/83 | 47 | 1.23/81 | | |
| 120 m/min | | 12 | 1.32/74 | 24 | 1.31/86 | 36 | 1.48/102 | 48 | 1.29/85 | | |

*The RA of the substrate was 1.2 microns prior to plating.

EXAMPLES 5–8

Repeating Examples 1–4, however, with the addition of the anti-dendritic agent (ADA) BLANCOL®-N resulted in lower surface roughness and/or peak count. The composition employed in examples 5–8 comprised:

Zinc Sulfate, Zn, 65 gl

BLANCOL®-N, 0.5 gm/l

Sulfuric Acid, enough to bring pH to 2.5 pH, 2.5

Temperature, 75° C.

Current density 50 A/dm$^2$, 100 A/dm$^2$, 150 A/dm$^2$, and 200 A/dm$^2$

Table 2 lists the results obtained with examples 5–8, at two concentrations of the ADA at 5 ml/l and 10 ml/l, the sample numbers surface roughness in microns and peak content listed in the same manner as in Table 1. Surface roughness decreased with the ADA at both five ml/l and 10 ml/l. The average $R_a$ after plating with the ADA was 1.29 microns with 5 ml/l and 1.37 microns with 10 ml/l ADA. The addition of the ADA gave a surface approximately 20% smoother in contrast to the comparative examples of Table 1. The ADA also enables the reduction of the peak count in several instances. In general, lower current densities give lower Pc values. The data also appear to indicate that neither solution flow rate, nor stir speed affect Pc.

Alloys of zinc may also be deposited employing the above formulation as additives to the coating bath. Nickel alloys are the most common alloys of zinc utilized in zinc-type corrosion protection coatings and the preparation of these type of alloy coatings are also within the scope of the present invention. Any of the other Group VIII metals may be used in this regard besides nickel, and include cobalt. Zinc alloys with Cr or Mn can also be plated. Mixtures of alloying metals from Group VIII and/or Group IIB or Cr or Mn may also be prepared, especially the two component or three component alloys where the alloying metal is present in the coating in an amount anywhere from about 0.1 to about 20 percent by weight and especially from about 5 to about 15 percent by weight.

The alloys are prepared by inserting the alloy metal into the coating baths either as an anode in a manner well known in the art or by adding a salt of the alloying metal to the coating bath.

Although the examples describe the electrogalvanizing process as one that is conducted on a steel substrate, any conductive metal substrate may be employed whether a pure metal or a metal alloy, and include other iron-alloy substrates or metals or alloys based on Groups IB, IIB, IIIA, IVA, IVB, VA, VB, VIB or VIIB, of the Periodic Table of Elements, the alloys comprising combinations of two or more of these metals and especially the two or three or four component combinations of metals. The alloying metal is present in the substrate in an amount anywhere from about 0.1 to about 20 percent by weight and especially from about 5 to about 15 percent by weight.

TABLE 2

| | Strip Speed | Solution Flow Rate | | 50 A/dm$^2$ Ra/Pc | | 100 A/dm$^2$ Ra/Pc | | 150 A/dm$^2$ Ra/Pc | | 200 A/dm$^2$ Ra/Pc |
|---|---|---|---|---|---|---|---|---|---|---|
| | | PRODUCTION ELECTROLYTE WITH ADA (5 ml/l) | | | | | | | | |
| Ex. 5 | 30 m/min | 21 m/min | 201 | 1.25/71 | 207 | 1.18/62 | 213 | 1.42/71 | 219* | 1.36/83 |
| | 60 m/min | | 202 | 1.29/51 | 208 | 1.20/61 | 214 | 1.17/66 | 220 | 1.18/62 |
| | 120 m/min | | 203 | 1.12/59 | 209 | 1.06/55 | 215 | 1.30/67 | 221 | 1.32/59 |
| Ex. 6 | 30 m/min | 63 m/min | 204 | 1.10/61 | 210 | 1.34/55 | 216 | 1.33/81 | 222 | 1.51/93 |
| | 60 m/min | | 205 | 1.13/59 | 211 | 1.25/62 | 217 | 1.34/69 | 223 | 1.60/67 |
| | 120 m/min | | 206 | 1.44/50 | 212 | 1.28/57 | 218 | 1.25/67 | 224 | 1.65/54 |
| | | PRODUCTION ELECTROLYTE WITH ADA (10 ml/l) | | | | | | | | |
| Ex. 7 | 30 m/min | 21 m/min | 225 | 1.17/63 | 231 | 1.22/66 | 237 | 1.33/73 | 243* | 1.19/78 |
| | 60 m/min | | 226 | 1.16/58 | 232 | 1.17/59 | 238 | 1.22/64 | 244 | 1.72/43 |
| | 120 m/min | | 227 | 1.14/56 | 233 | 1.20/58 | 239 | 1.56/59 | 245 | 1.40/52 |
| Ex. 8 | 30 m/min | 63 m/min | 228 | 1.25/59 | 234 | 1.40/57 | 240 | 1.35/60 | 246* | 1.68/70 |
| | 60 m/min | | 229 | 1.07/60 | 235 | 1.12/64 | 241 | 1.49/46 | 247 | 1.87/52 |
| | 120 m/min | | 230 | 1.18/67 | 236 | 1.19/59 | 242 | 2.08/46 | 248 | 1.70/52 |

The various numerical ranges describing the invention as set forth throughout the specification also include any combination of the lower ends of the ranges with the higher ends of the ranges set forth herein including, inter alia, ranges of concentrations of compounds, ratios of the these compounds to one another, pH, current densities, temperatures, as well as all whole number and/or fractional number values and ranges encompassed within these ranges.

It will be apparent to those skilled in the art that various modifications and variations can be made to the composition and process of the invention without departing from the spirit or scope of the invention. It is intended that these modifications and variations of this invention are to be included as part of the invention, provided they come within the scope of the appended claims and their equivalents.

What is claimed is:

1. A process for reducing high current density dendrite formation and controlling high current density roughness, grain size and orientation of a zinc coating comprising applying said coating to a cathode substrate immersed in a composition of matter consisting essentially of an acidic aqueous zinc salt and a sulfonated condensation product of naphthalene and formaldehyde as an antidendritic agent, and passing a current of from about 525 to about 4,000 ASF from an anode in said composition to said cathode in said composition for a period of time sufficient to deposit a zinc coating on said cathode whereby said zinc coating shows reduced high current density dendrite formation, and controlled high current density roughness, grain size and orientation.

2. The process of claim 1 wherein the current density is from about 525 to about 3,000 ASF.

3. The process of claim 2, wherein said sulfonated condensation product comprises a methoxylated sulfonated condensation product of naphthalene and formaldehyde.

4. The process of claim 2, wherein said zinc salt comprises a zinc salt of a sulfur acid.

5. The process of claim 2, wherein said zinc salt comprises zinc sulfate.

6. The process of claim 1, wherein said sulfonated condensation product further comprises a methoxylated sulfonated condensation product of naphthalene and formaldehyde.

7. The process of claim 1, wherein said zinc salt comprises a zinc salt of a sulfur acid.

8. The process of claim 1, wherein said zinc salt comprises zinc sulfate.

* * * * *